US005160144A

United States Patent [19]

Maniatis

[11] Patent Number: 5,160,144

[45] Date of Patent: Nov. 3, 1992

[54] GOLF PUTTER INCLUDING TUNING FORK EFFECTS

[76] Inventor: Jimmy J. Maniatis, 8010 Dundee, San Antonio, Bexar County, Tex. 78209

[21] Appl. No.: 787,223

[22] Filed: Nov. 4, 1991

[51] Int. Cl.[5] ..... A63B 69/36

[52] U.S. Cl. ..... 273/186.2; 273/78; 273/168

[58] Field of Search ..... 273/78, 186 A, 162 R, 273/162 E, 162 F, 193 R, 194 R, 167 J, 167 A, 183 D, 168

[56] References Cited

U.S. PATENT DOCUMENTS

D. 209,301 11/1967 Comitz ..... 273/78 X 4,123,056 10/1978 Nakamatsu ..... 273/78

*Primary Examiner*—George J. Marlo

*Attorney, Agent, or Firm*—Donald R. Comuzzi

[57] ABSTRACT

The present invention is a golf putter having a putter head which is vertically sliced from the sole all the way into the neck to form first and second opposing portions. Those portions produce tuning fork effects which are shaft vibrations and the corresponding tone. A golfer using the touch and sound can develop a reproducible and therefore more accurate putting stroke. Additionally, the tuning fork configuration allows putter head flexing which imparts extra velocity to the golf ball.

3 Claims, 1 Drawing Sheet

GOLF PUTTER INCLUDING TUNING FORK EFFECTS

BACKGROUND OF THE INVENTION

The present invention relates to a golf putter and, more particularly, to a putter that produces vibrations up the shaft and emits a specific audio tone when the "sweet spot" is used to strike the golf ball.

The key to playing consistent golf and scoring well is the ability to constantly reproduce or repeat the same swing or stroke. That is especially true in putting where minimal errors in speed and direction are magnified as the golf ball progresses towards the hole causing errant putts. Even with the introduction of perimeter weighing systems, conventional golf clubs and putters have only one true "sweet spot". Unless a putter stroke is developed that allows a golfer to consistently strike the golf ball with the "sweet spot" an accomplished putting game will never be achieved. Unfortunately, conventional putters are not designed to aid a golfer, particularly a novice, in finding the correct spot on the putter with which to strike the golf ball.

Thus, the putter of the present invention has been designed so that it produces recognizable vibrations in the shaft as well as emits a recognizable audio tone when the correct spot on the putter head is used to strike the golf ball, thereby allowing stroke reproducibility.

SUMMARY OF THE INVENTION

The present invention is a putter wherein the putter head has been sliced vertically from the sole all the way into the neck. That slice creates first and second portions joined at the neck. The first and second portions have symmetrical shapes and faces and oppose one another which creates a tuning fork design. The advantage that that design offers is that when the golf ball is struck, the putter head flexes and then recoils causing the golf ball to pop off the front of the putter, thereby imparting added velocity to the ball in the aimed direction. Errant putts can be caused when the desired path the putter is to travel is deviated from; therefore any design which allows a smaller putter stroke produces more accurate putting results. Additionally, the tuning fork design caused by the slice through the sole and into the neck creates a tuning fork effect when the ball is struck such that recognizable vibrations which travel up the shaft are produced, and a specific audible tone is emitted. Thus, with practice, a golfer will know every time the ball has been struck properly because of the sounded tone and vibrational feel produced in the putter shaft. Accordingly, a completely reproducible solid stroke may be developed which will greatly improve putting ability.

Therefore, it is an object of the present invention to provide a putter that increases striking firmness and stroke reproducibility using a tuning fork effect.

Other features and advantages of the present invention will become evident to those skilled in the art in light of the following detailed description.

DETAILED DESCRIPTION OF THE PREFERRED EMBODIMENT

Figure 1:
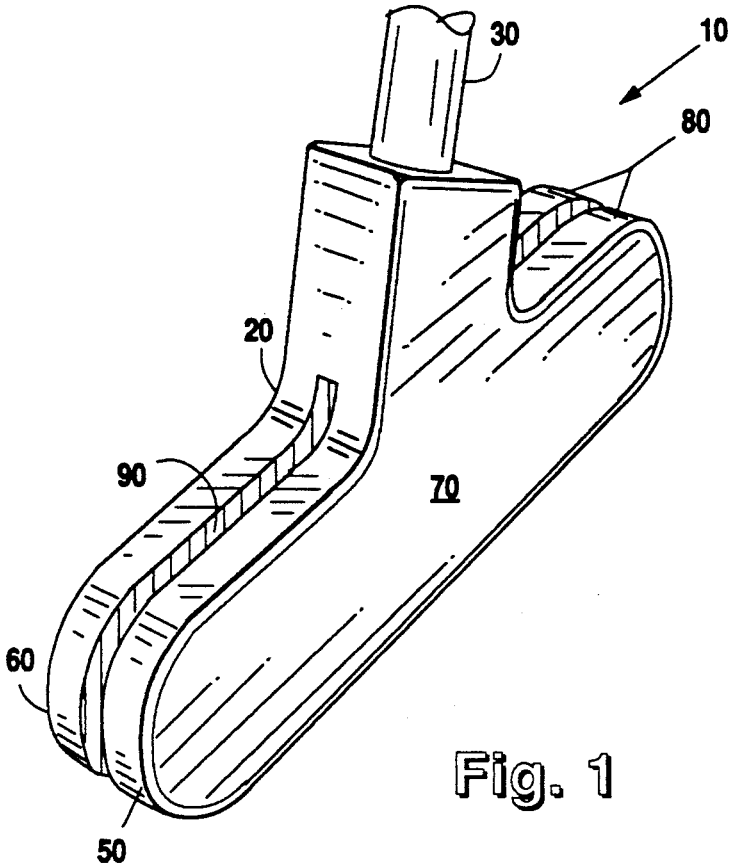
FIG. 1 is a perspective view of the putter of the present invention.
Figure 2:
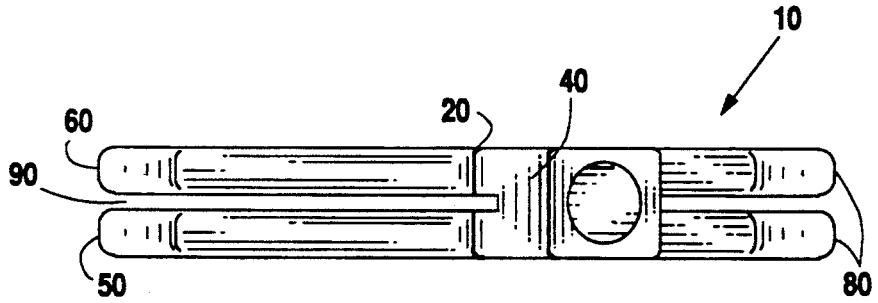
FIG. 2 is a top view of the putter of the present invention.
Figure 3:
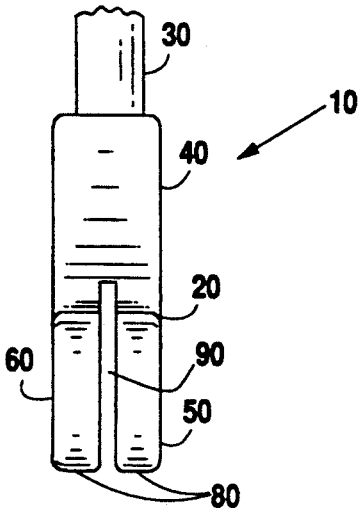
FIG. 3 is a front view of the putter of the present invention.

Referring to FIG. 1-3, the design and features of putter 10 will be disclosed. Putter 10 comprises head 20 having sole 80 and neck 40 which are formed as an integral member. Additionally, putter 10 comprises shaft 30 which is attached to head 20 at neck 40 using any conventional means such as glue.

Head 20 is provided with slice 90 which is a vertical cut completely through sole 80 extending into neck 40. Slice 90 divides sole 80 to form first portion 50 and second portion 60. First portion 50 and second portion 60 oppose one another, are symmetrical, and each is provided with a vertical face 70 used as the putter striking surface. Sole 80 is sliced such that first portion 50 and second portion 60 form a tuning fork.

That design produces three advantages over conventional putters. First, slice 90 creates a space between first portion 50 and second portion 60 which allow the portion used to strike the ball to flex and then recoil causing the ball to firmly pop off the putter imparting added velocity to the ball in the aimed direction. Second, when the ball is struck, the tuning fork configuration of first portion 50 and second portion 60 emit a tone which is noticeable to the golfer. That tone will vary dependent upon which portion of face 70 is struck. Therefore, the desired striking spot can easily be learned based upon the emitted tone. Third, the vibrations which cause the tone are additionally transferred up the shaft so that the putter user can feel the vibrations. That allows both hearing and touch be used in order to learn the correct position on face 70 to strike the ball to ensure proper putting.

The present invention is constructed of any conventional material such as a metal or alloy used in putter construction, although any suitable material could be substituted.

From the foregoing description and illustration of this invention, it is apparent that various modifications can be made by reconfigurations or combinations to produce similar results. It is, therefore, the desire of the Applicant not to be bound by the description of this invention as contained in this specification, but to be bound only by the claims as appended hereto.

I claim:

1. A putter, comprising:

a head comprising a sole and a neck and having a slice extending through said sole into said neck to provide faces which produce a tuning fork effect when a ball is struck with one of said faces; and a shaft attached to said head at said neck.

2. The putter according to claim 1 wherein said slice is vertical and divides said sole into first and second faces joined at said neck.

3. The putter according to claim 2 wherein said first and second faces are symmetrical.

* * * * *